United States Patent [19]

Reitter

[11] 4,373,678

[45] Feb. 15, 1983

[54] ROTARY IMPACT CRUSHER HAVING A CONTINUOUS ROTARY CIRCUMFERENCE

[76] Inventor: Guenther W. Reitter, 2811 Meriln Rd., Camp Hill, Pa. 17011

[21] Appl. No.: 163,956

[22] Filed: Jun. 30, 1980

[51] Int. Cl.[3] ..... B02C 13/28

[52] U.S. Cl. ..... 241/189 R; 241/294

[58] Field of Search ..... 241/189 R, 189 A, 191, 241/192, 195, 294, 295, 197, 188 A

[56] References Cited

U.S. PATENT DOCUMENTS

| | | | |
|---|---|---|---|
| 247,749 | 10/1881 | Dawson | 241/191 |
| 1,120,250 | 12/1914 | Sturtevant . | |
| 1,864,973 | 6/1932 | Buchanan . | |
| 2,585,943 | 2/1952 | Kessler | 241/191 |
| 2,618,438 | 11/1952 | Chrystal . | |
| 2,747,803 | 5/1956 | Hanse | 241/191 |
| 2,862,669 | 12/1958 | Rollins . | |
| 2,958,474 | 11/1960 | Meyer . | |
| 3,128,953 | 4/1964 | Wageneder . | |
| 3,146,961 | 9/1964 | Putnam . | |
| 3,151,816 | 10/1964 | Hanse et al. | 241/191 |
| 3,202,368 | 8/1965 | Nixon . | |
| 3,480,214 | 11/1969 | Wageneder . | |
| 3,608,841 | 9/1971 | Wageneder et al. . | |
| 3,652,023 | 3/1972 | Wood . | |
| 3,784,117 | 1/1974 | Koenig et al. . | |
| 3,847,362 | 11/1974 | Lowe et al. . | |

FOREIGN PATENT DOCUMENTS

| | | | |
|---|---|---|---|
| 225012 | 12/1962 | Austria | 241/189 R |
| 1976040 | 8/1977 | Fed. Rep. of Germany . | |
| 1934545 | 11/1978 | Fed. Rep. of Germany . | |
| 963643 | 7/1964 | United Kingdom | 241/189 R |

*Primary Examiner*—Mark Rosenbaum

*Attorney, Agent, or Firm*—Thomas Hooker

[57] ABSTRACT

A rotary impact crusher is characterized by a continuous rotary circumference formed by a plurality of plates along the orbit of rotation described by the crusher impeller blades and extending from each impeller blade to each next blade. The impeller blades are secured to the crusher body by a combination wedge means comprising a truncated, thick walled cylinder and a polyhedron with matching inclined planes. Both the plates and the impeller blades are symmetrical in shape, and combination wedge means is located at a point of least stress to each impeller blade.

6 Claims, 7 Drawing Figures

ROTARY IMPACT CRUSHER HAVING A CONTINUOUS ROTARY CIRCUMFERENCE

In crushing or pulverizing, materials such as stone, coal, slag or the like are reduced to a suitable size for uses such as road building, concrete aggregate and furnace firing. The reduction in size may be accomplished by compression, which is the slow application of a large force; impact, a rapid blow as by a hammer; attrition, a rubbing or shearing; or by a combination of these techniques.

The present invention relates to a rotary disintegrator such as a rock crusher or hammermill. Prior crusher devices have been described in U.S. Pat. No. 3,480,214 and U.S. Pat. No. 3,608,841, relating to rotary disintegrators, such as rock crushers, having a housing with an inlet for feed material, an impeller rotatable around a horizontal axis and provided with at least one axially extending impeller blade projecting outwardly of the impeller. The material to be crushed is admitted from above into the impact chamber so that it falls onto and is impacted by the impeller blades. Material which is impacted by the impeller blades is flung against plates that line the housing. Repeated impacting of the material by the blades and the plates causes the crushing of the material. In theory, force is applied to the material in the form of blows and impacts until the cohesion of the material collapses. The energy to break the material is applied at high speed in the form of kinetic energy. This type crusher employs no significant amount of other kinds of crushing actions such as attrition, shearing and/or compression.

Devices of this general nature are advantageous in that they are characterized by a relatively high capacity for treating materials related to power consumption and further by a high reduction ratio. These devices are capable of comminuting fairly large materials to discharges of relatively fine product. In order to achieve the advantages of the rotary disintegrators described here, it is necessary to maintain a high rotor speed in a range of 600 to 1,500 revolutions per minute—or in terms relating to conventionally sized crushers—6,000 to 15,000 feet per minute of impact speed. The higher the reduction ration intended, i.e. the finer the product desired, the faster the rotor must be operated. Operation at these high speeds causes certain problems including accelerated wear of breaker blades and plates, and the production of dust. Production of dust is disadvantageous because of the waste of material and the development of dust control problems. To a degree, the prior art crushers reduce these problems.

U.S. Pat. No. 3,480,214 specifically relates to a rotary disintegrator provided with a pair of swingable grates disposed below the rotor with a curvature approximating that of the blade orbit—the two grates being separated from each other by a small gap at the nadir of the rotor and forming two independently adjustable clearances for the materials to be comminuted. The second grate may have its entrance edge disposed slightly below the level of the discharge edge of the first grate to intercept larger fragments accelerated across the gap; above the exit of the ascending clearance formed between the rotor and the second grate, a deflector plate intercepts particles not previously discharged.

U.S. Pat. No. 3,608,841 relates to a rotary disintegrator provided with one arcuate baffle extending beneath the impeller and along an arc segment of approximately 90 degrees. This device provides improved product control by decreasing the amount of oversize by means of the pivotal, cylindrical, concave baffle which is provided along a segment of the rotor orbit. Further, this baffle may be movable so that the impeller blade wear may be compensated for by adjusting the concave baffle in the direction of the rotor orbit.

In operation, it is an objective of the prior art crushers and similar devices, to minimize impeller blade wear while maximizing product size control. These objectives work against one another. Thus, reducing the speed of the rotor decreases wear, however, this results in loss of product size control. The present invention addresses itself to those objectives as well as to others. It relates specifically to crushing devices of the type disclosed in the cited patents and has general applicability to rotary impact disintegrators as described.

It is proposed by the present invention to provide a rotary disintegrator capable of operating at lower speeds than those necessary in either conventional impact crushers or those utilizing the features of the prior art devices. A device is provided that permits disintegration at lower speeds, thus preventing over-crushing of large size feed, reducing wear on equipment and minimizing dust production. The invention is describable as a rotary impact crusher comprising an impeller, rotatable about a horizontal axis and provided with at least four axially extending impeller blades mounted on the circumference of the impeller and a plurality of peripheral plates mounted on the circumference of the impeller between the blades to provide the impeller with a continuous rotary circumference along the orbit of rotation described by the impellers while in rotation. One plate extends from each impeller blade to each next impeller blade to close the circumferential spaces between the blades. This structure permits the operation of impact crushers at lower speeds than those previously used bringing about the advantages as already described. Devices already known in the art could not be operated at these lower speeds because material would overcome the centrifugal force imposed by impeller velocity and would penetrate into the rotor to cause damage, clogging and at least a decrease in the efficiency of the comminuting action. The present invention is particularly applicable to a device of the type shown in the cited patents since there the problem of material penetration into the rotor area is compounded by use of the curved grate.

Another aspect of the present invention relates to a combination wedge means for securing the replaceable impeller blades to the impeller. This wedge means comprises a truncated, thick walled cylinder and a polyhedron characterized by a plane to cooperate with the plane formed by the truncation of the cylinder, and a lip to loosely engage a rim of an impeller blade formed by a notch beneath the lower shoulder of the blade.

The combination wedge for each blade is positioned at a peripheral recess in the shaft plates extending from the rotary axis. The wedge is aligned with a recess in each impeller blade at a following lower edge—a point of minimum stress. A slanted plane of the cylinder cooperates and presses against a corresponding surface of the polyhedron. The polyhedron fits within the recess of the blade. A plane of the polyhedron is urged against the body of the blade while the lip of the polyhedron rests within the recess and in operation "catches" the edge of the recess to provide a removable but secure fitting. This double wedge combination is particularly advantageous because it is accessable for removal or adjustment even with the peripheral plates of the present invention.

Another aspect of the present invention, illustrated in the drawings, is the symmetrical shape of the impellers and peripheral plates. This permits these elements to be removed and turned to a new work position whenever a blade edge or plane is worn to the point of adversely affecting operation. In a preferred embodiment, the impact crusher has symmetrically shaped impeller blades having an upper leading and an upper following edge and a lower leading and lower following edge extending outwardly to form four arms and shoulders.

Other objects and features of the invention will become apparent as the description proceeds, especially when taken in conjunction with the accompanying drawings illustrating the invention, of which there are six sheets and two embodiments.

FIG. 3 is a sectional view taken on the line A—A of FIG. 2;

Figure 1:
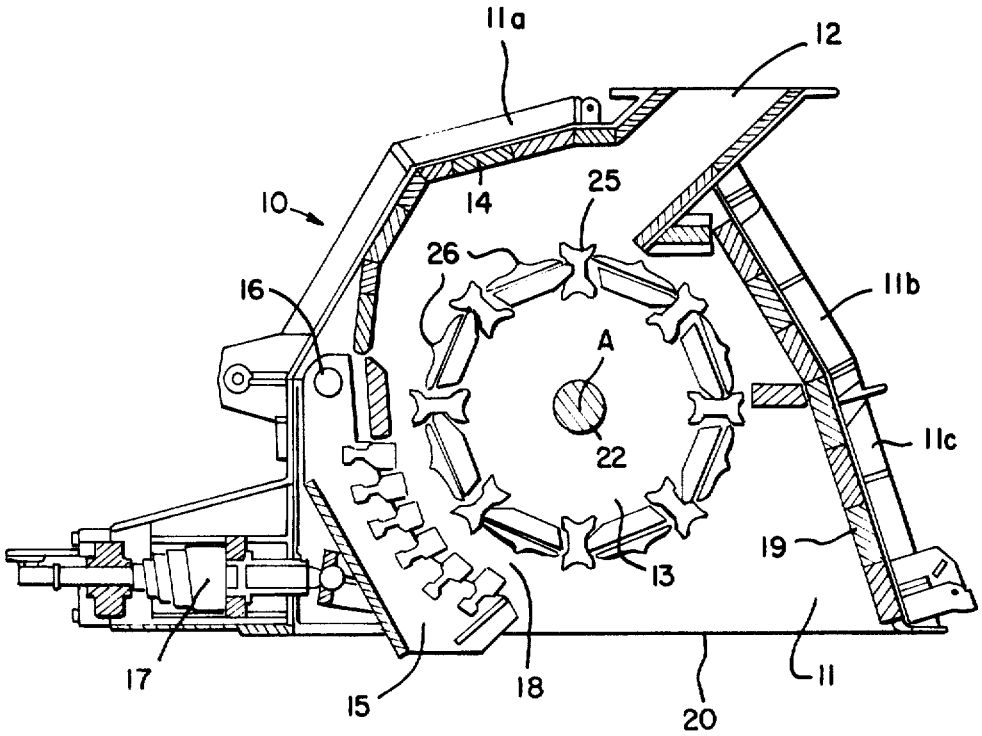
FIG. 1 is a cross-sectional view of an impact crusher embodying the present improvements.

Referring to FIG. 1, the rotary crusher 10 has a housing 11 with a pivotal top 11*a* and pivotal doors 11*b* and 11*c*. Rock or the like is loaded into the feed opening 12 toward the turning impeller 13. The impeller 13 spins in a counter-clockwise direction as it is depicted in FIG. 1. As it turns, it flings rock feed against a series of breaker plates 14. This effectively smashes the larger fragments. The feed is then conveyed by the impeller 13 down toward baffle 15. At this point the clearance between the orbit of the impeller 13 and the baffle 15 may be adjusted by screw and spring arrangement 17 which operates to pivot the baffle 15 at shaft 16 to reduce the gap 18 between the rotor orbit and baffle 15. Adjustment of the clearance between the baffle 15 and rotor orbit can be utilized to affect the size of the product. As the partially fragmented rock is carried around against the baffle 15 by the impeller 13, it is fully milled and reduced to desired size. The feed is then projected in the form of a hail of particles against the lining 19 of the door 11*c* and then discharged from the bottom 20 of the crusher.

Figure 2:
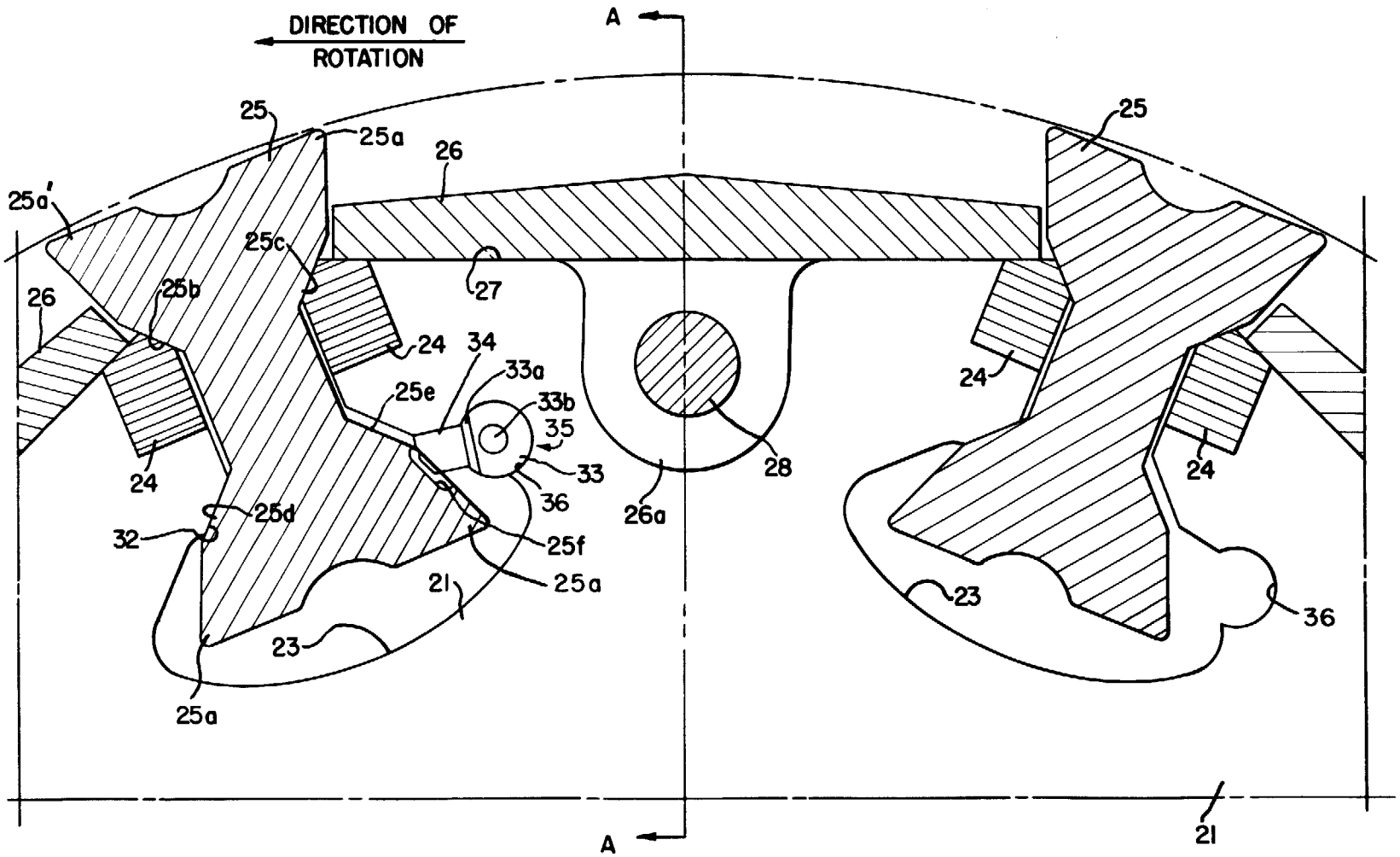
FIG. 2 is a detailed view of a section of the crusher of FIG. 1 showing two impeller blades and adjoining peripheral plate.

Referring to FIGS. 2 and 3, the exemplary impeller arrangement shown is characterized by two shaft plates 21 rotatable with drive shaft 22 (shown in FIG. 1) and radially extending outwardly from said shaft. The plates 21 include a plurality of aligned peripheral recesses 23, the recesses in the two plates being aligned axially of each other to receive impeller blades 25. Bars 24 are welded between the plates 21 on either side of the recesses, to support impeller blades 25 and peripheral plates 26. Plates 26 cover adjacent spacing between the blades 25 to form a continuous circumferential surface along the impeller orbit. This structure prevents the incursion of feed material into the impeller 13 while being operated at low speeds.

Figure 7:
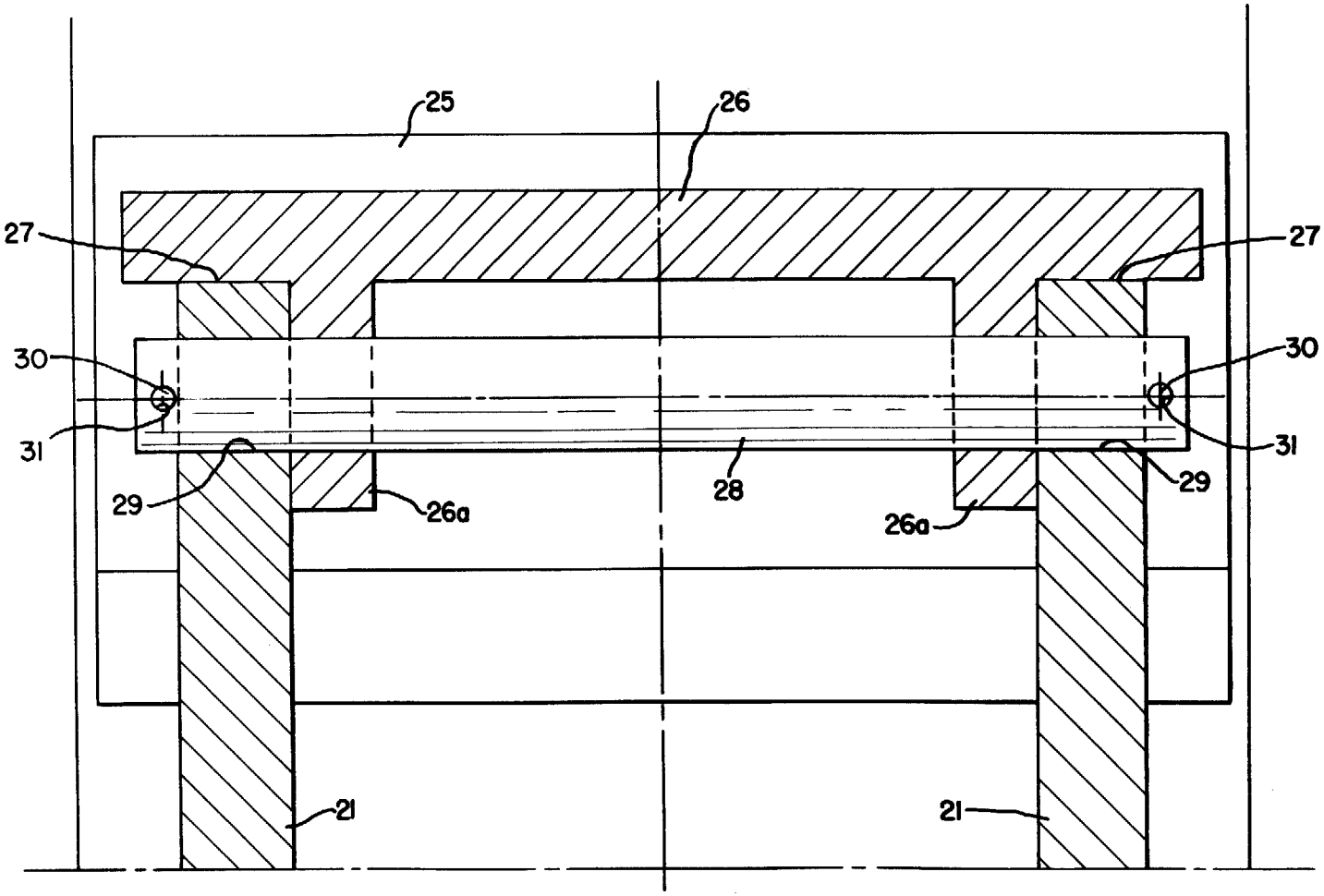
FIG. 7 is a sectional view taken on line B—B of FIG. 6.
Figure 4:
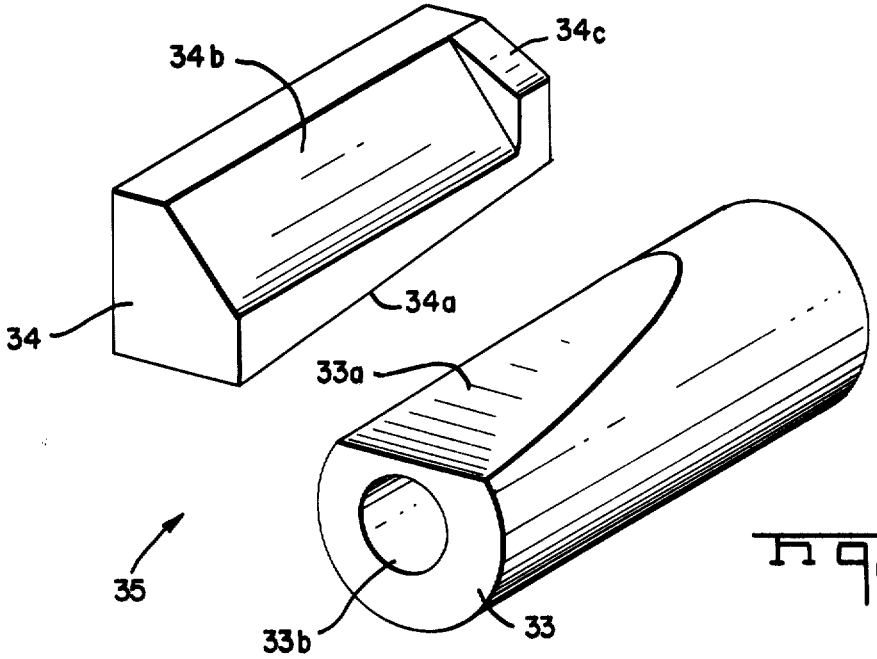
FIG. 4 is an isometric view of the two parts of the combination wedge means for supporting the replaceable impeller blades.
Figure 5:
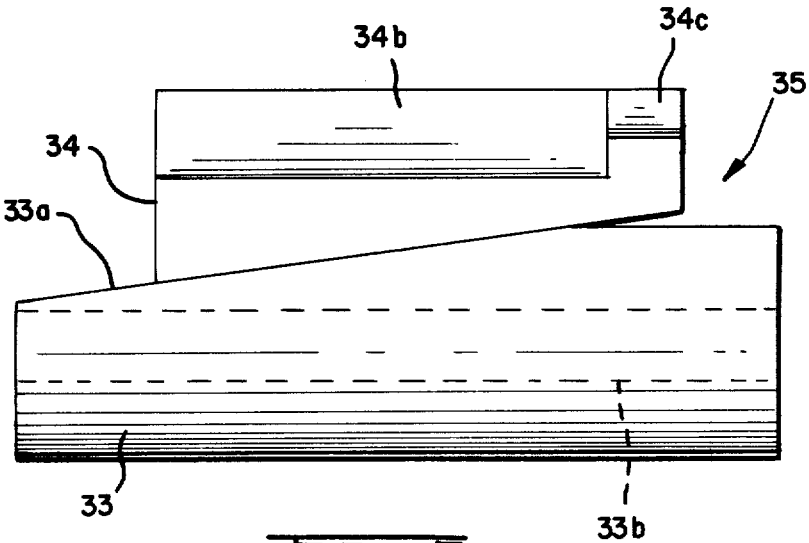
FIG. 5 is a sectional view of the combination wedge means showing the cooperation of planes of the two parts.
Figure 6:
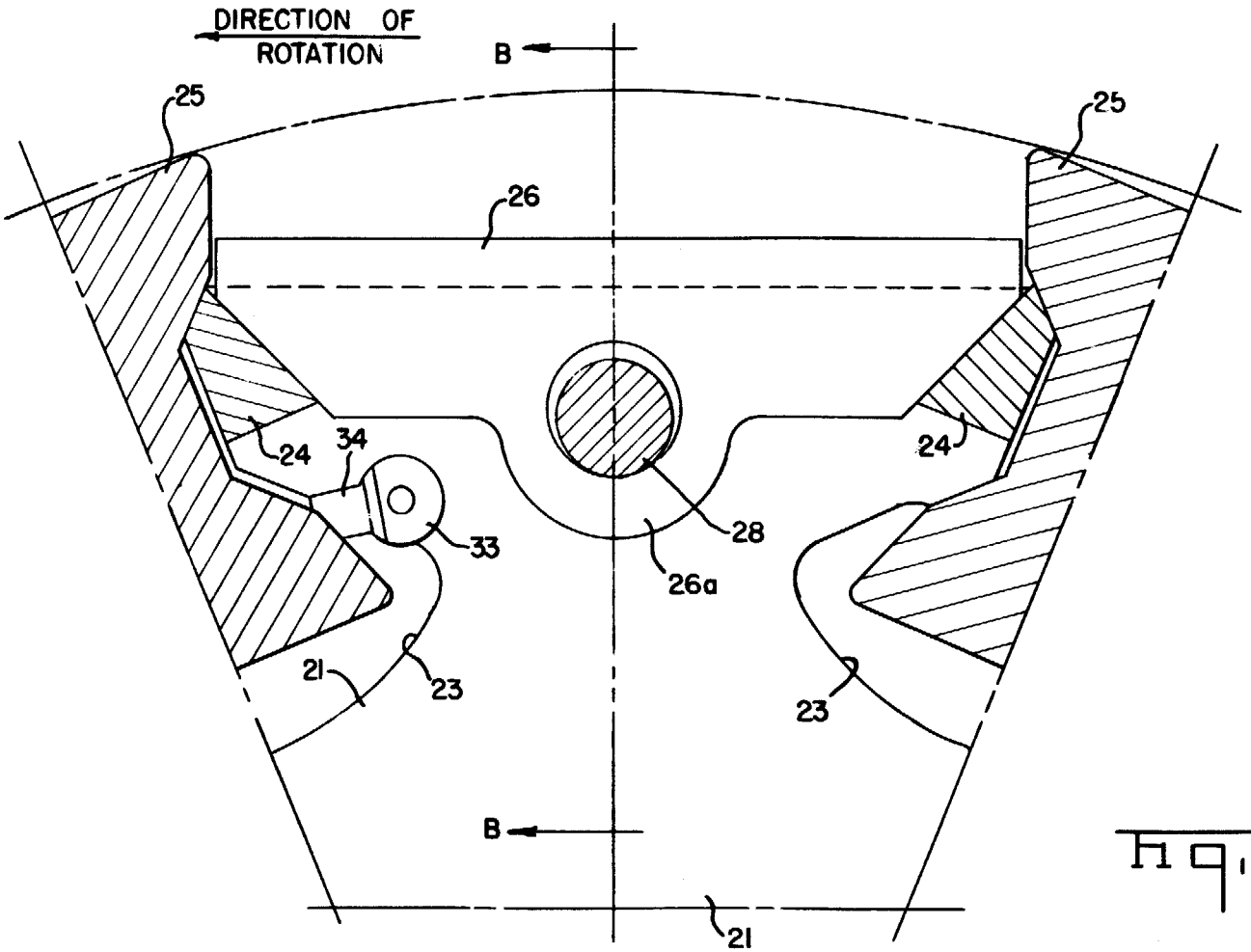
FIG. 6 is a view of a section of the crusher showing another embodiment of the intervening plate.
Figure 7:
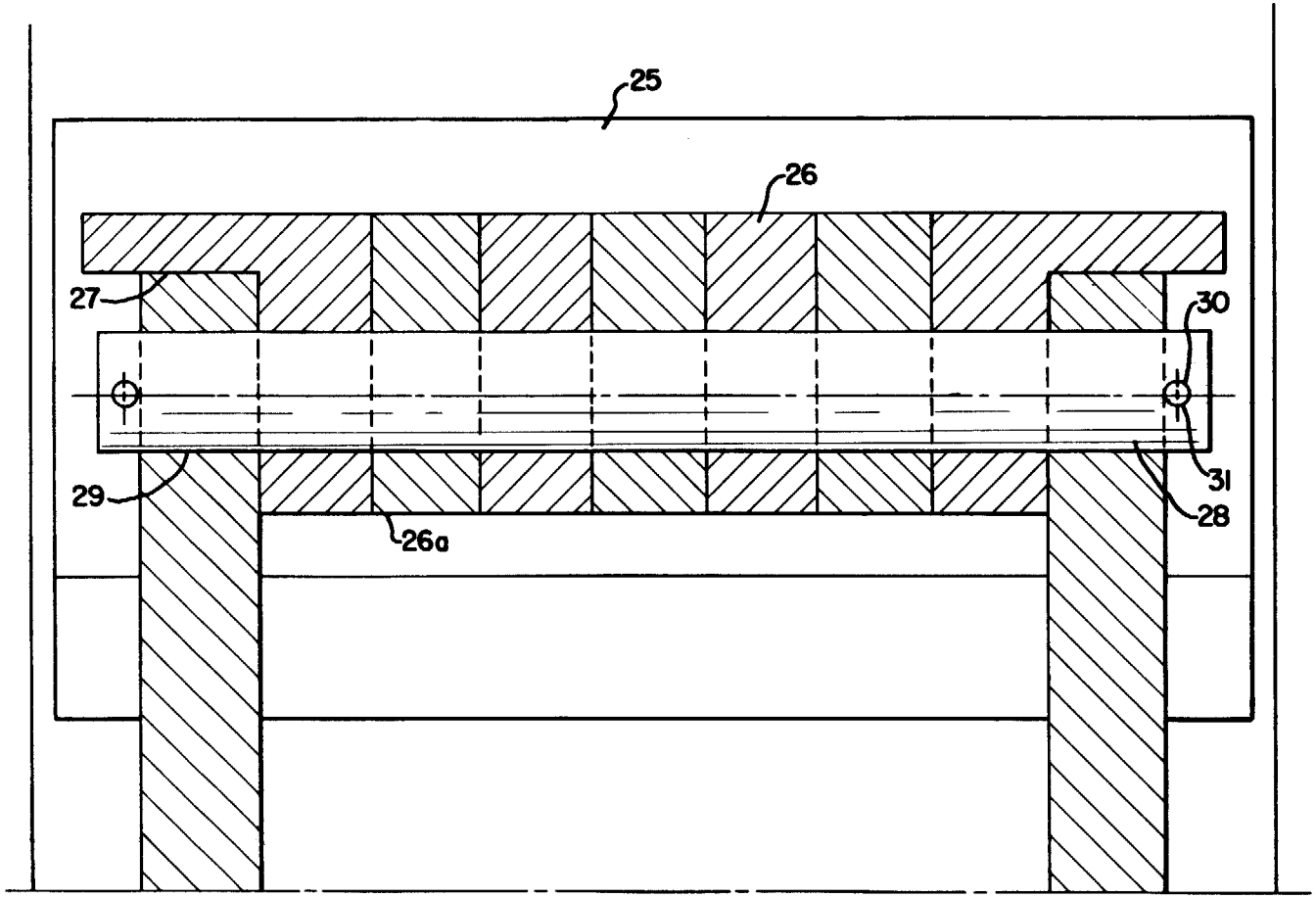

Each plate 26 rests on flat surfaces 27 of shaft plates 21 and is provided with at least two attaching eyes 26*a*. A shaft 28 extends through eyes 26*a* and holes 29 in plates 21 to secure plates 26 against centrifugal force while the impeller 13 is in operation. Shaft 28 is held in place by means of pins 30, one on the outside of each plate 21 and mounted in holes 31 in the shaft 28. The shaft plates 21 support blade 25 at surface 32. The plate 26 is supported by the shaft plates 21 at the point of attachment, i.e. the hinge eyes, thus minimizing wear at a critical attachment point and permitting conventional attachments since the hinge attachment acts only to resist centrifugal force. Because of the support of the plate at bars 24, force of the feed against the plate is resisted. In the embodiment shown, the plate rests partially on bars 24 and partially on the surfaces 27. In another embodiment the plate may rest solely on a bar 24 bearing no weight or force on surfaces 27. This latter embodiment is illustrated in FIG. 6 and in FIG. 7. As shown in FIG. 6, plate 26 is supported by bars 24 which are welded between and bridge shaft plates 21. The angle between the bars 24 and the adjacent flanks of plate 26 should be between 60 and 180 degrees. Also, the angle between bar 24 and the blade 25 is supports should be between 45 and 90 degrees to the radius of the rotor.

As indicated, the present invention utilizes symmetrical pieces in order to provide one of the advantages as described. Plate 26 illustrates this principle. Further, as shown, impeller blade 25 is symmetrically shaped with four like edges 25*a*. The blade 25 preferably is symmetrical, to either side of a radial plane so that it may be reversed more than once as wear occurs. Hence, as one leading edge 25*a* becomes worn, the blade may be reversed to expose a fresh leading edge to the feed.

The impeller blade shown has a narrow waist and four bevelled shoulders 25*b*, 25*c*, 25*d* and 25*e* which form an angle of between 35 and 60 degrees with the radius of the impeller 13. While in operation, the shoulders 25*b*, 25*c*, and 25*d* of the impeller blade 25 are subjected to the greatest stress from feed impact and the crushing operation. In accord with another aspect of this invention, the blade 25 is supported at these surfaces. Hence, the drawings show outwardly facing bars 24 under blade shoulders 25*b* and *c* and inwardly facing support surface 32 of plates 21 supporting the outward facing shoulder 25*d*.

A combination wedge means 35 is positioned at the point of lowest stress 25*e* located radially inwardly of the trailing edge of each blade 25. The means consists of a cylindrical wedge 33 and polyhedron 34. The slanted surface 33*a* cooperates and presses against the corresponding surface 34*a* of polyhedron 34. The polyhedron 34 fits within the recess 25*f* provided in the blade shoulder 25*e*. The wedge 33 fits in cylindrical recess 36 formed in one side of larger plate recess 23 opposite impeller blade recess 25*f*. The plane 34*b* of the polyhedron is urged against the body of the blade 25 while the lip 34*c* of the polyhedron rests within recess 25*f* and in operation "catches" the edge of recess 25*f* to provide a removable but secure fitting. Truncated cylinder 33 is engaged within recess 36 in body 21. Its slanted surface 33*a* cooperates with the surface 34*a* of polyhedron 34 to lock the impeller blade in position. In its secured position the cylinder is biased outward by the constriction of the recess and against the polyhedron 34. This provides a secure and firm fitting while at the same time permits the polyhedron to loosely engage the edge of recess 25*f*. Truncated cylinder 33 further may be secured by means of a bar (not shown) through its axial bore 33*b*.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What is claimed is:

1. A rotary impact crusher impeller having a drive shaft, two spaced shaft plates mounted on the shaft and extending radially outwardly of the shaft, impeller blade recess in the periphery of each shaft plate, a plurality of impeller blades spaced around the periphery of each shaft plate with each blade extending through an impeller blade recess in each shaft plate and the longitudinal axis of the blade generally parallel to the axis of the rotary shaft, wherein the improvement comprises a plurality of peripheral plates each having a radial inner surface, each peripheral plate overlying the opening between two adjacent impeller blades and the spaced shaft plates, the radial inner surfaces of the peripheral plates resting upon the outer peripheral surfaces of the shaft plates between the adjacent impeller blades, a mounting member on the radial inner surface of each peripheral plate and removable mounting means engageable with the mounting members for securing the peripheral plates to the impeller against centrifugal forces wherein the impeller blades and peripheral plates form an essentially continuous surface extending around the impeller for preventing work from falling into the impeller interior during low-speed crushing.

2. An impeller as in claim 1 including a bar extending between the shaft plates at each side of aligned pairs of impeller blade recesses, the radial inner surfaces of the peripheral plates overlying outwardly facing edges of said bars so as to support the peripheral plates between the shaft plates.

3. An impeller as in claim 2 wherein the peripheral outer surfaces of the shaft plates between adjacent impeller blade recesses and the outer facing surfaces of the bars are all planar and the radial inner surfaces of the peripheral plates are planar adjacent such surfaces to permit flush mounting of the peripheral plates on the impeller.

4. An impeller as in claim 2 wherein said bars include radially outwardly facing impeller blade supporting surfaces engaging inwardly facing impeller blade surfaces, the impeller is adapted for rotation in a given direction about the axis of the drive shaft so that the impeller blades have leading and trailing edges and including clamp means for securing each impeller blade to a shaft plate, such clamp means being located radially inwardly of the trailing edge of the impeller blade, and an impeller blade support surface in each recess located radially inwardly of the leading edge of each impeller blade.

5. An impeller as in claim 1 wherein the mounting member includes an eye and said mounting means including a mounting shaft extending through the eye and into a bore in at least one of said shaft plates.

6. An impeller as in claim 1 wherein said mounting member comprises a pair of eyes extending radially inwardly from the inner surface of the plate adjacent the shaft plates, bores extending through the shaft plates and including an attachment shaft extending through said bores and eyes for holding the peripheral plate to the impeller.

* * * * *